US007223150B2

(12) United States Patent
Chernick et al.

(10) Patent No.: US 7,223,150 B2
(45) Date of Patent: May 29, 2007

(54) ILLUMINATED ELASTOMERIC FLYING DISC AND ITS METHOD OF MANUFACTURE

(76) Inventors: Mark Chernick, 19180 144th Ave., NE., Woodinville, WA (US) 98072; Webb T. Nelson, 19180 144th Ave., NE., Woodinville, WA (US) 98072; Dustin S. Chernick, 19180 144th Ave., NE., Woodinville, WA (US) 98072; Adam J. Chernick, 19180 144th Ave., NE., Woodinville, WA (US) 98072; Martin L. Nelson, 19180 144th Ave., NE., Woodinville, WA (US) 98072

( * ) Notice: Subject to any disclaimer, the term of this patent is extended or adjusted under 35 U.S.C. 154(b) by 0 days.

(21) Appl. No.: 10/865,770

(22) Filed: Jun. 14, 2004

(65) Prior Publication Data

US 2005/0277356 A1 Dec. 15, 2005

(51) Int. Cl.
*A63H 27/00* (2006.01)

(52) U.S. Cl. ..... 446/47; 446/34; 446/175

(58) Field of Classification Search ..... 446/46, 446/47, 34, 175, 219, 220–226; 244/12.2, 244/23 C; 473/588, 570, 571, 589
See application file for complete search history.

(56) References Cited

U.S. PATENT DOCUMENTS 1,530,923 A * 3/1925 Falkner ..... 446/224
1,776,182 A * 9/1930 Cook ..... 40/555
3,948,523 A * 4/1976 Michael ..... 473/588
4,301,616 A * 11/1981 Gudgel ..... 446/47
4,869,699 A * 9/1989 Plambeck et al. ..... 446/47
5,032,098 A * 7/1991 Balogh et al. ..... 446/47
5,119,281 A * 6/1992 Akman ..... 362/253
5,319,531 A * 6/1994 Kutnyak ..... 362/184
5,324,222 A 6/1994 Chen ..... 448/34
5,413,332 A * 5/1995 Montgomery ..... 473/570
5,499,941 A * 3/1996 Penjuke, Sr. ..... 446/222
5,609,411 A * 3/1997 Wang ..... 362/234
5,611,720 A * 3/1997 Vandermaas ..... 446/47
5,938,499 A * 8/1999 Chen ..... 446/253
5,984,098 A * 11/1999 Cahen et al. ..... 206/457
6,475,609 B1 * 11/2002 Whitney et al. ..... 428/212
6,533,637 B1 * 3/2003 Liao ..... 446/267
6,798,120 B1 * 9/2004 Fearing et al. ..... 310/331
2003/0228446 A1 * 12/2003 Pearce ..... 428/166

* cited by examiner

*Primary Examiner*—Bena Miller
(74) *Attorney, Agent, or Firm*—LaMorte & Associates

(57) ABSTRACT

An internally illuminated toy having a flexible body that is made from an elastomeric gel. The flexible body defines an internal chamber that is accessible through a small access opening. An electronics module is provided that contains a light source. The electronics module is inserted into the internal chamber of the flexible body by hyper-extending the access opening. Once inside the internal chamber, the access opening elastically contracts and the electronics module is trapped within the flexible body. When activated, the electronics module illuminates, thereby internally illuminating the flexible body of the toy.

15 Claims, 5 Drawing Sheets

ILLUMINATED ELASTOMERIC FLYING DISC AND ITS METHOD OF MANUFACTURE

BACKGROUND OF THE INVENTION

1. Field of the Invention

In general, the present invention relates to flying-disc projectile toys. More particularly, the present invention relates to flying-disc projectile toys that are made from elastomeric material and flying disc toys that are illuminated.

2. Description of Related Art

Flying disc toys, such as the Frisbee™, have been popular in the toy marketplace for decades. In this period of time, there have been many variations to the design and structure of toy flying discs. Toy flying discs have been made from metal, wood and plastic. Furthermore, a variety of different electronic light modules have been attached to flying disc toys so that the flying discs will appear illuminated during low light conditions.

Within the past few years, advancements have occurred in the field of polymer science that have enabled highly elastic gel materials to be produced. These elastic gels are also very resistant to tearing. These elastomeric gels are produced by mixing oils with various tri-block copolymers. Since such gel materials are soft, they have been adapted for use in the field of projectile toys, in order to make the projectile toys safer.

Elastomeric gels have been used in the manufacture of flying discs. This was done to make the disc easier to store, easier to hold, easier to catch and less inclined to cause impact damage. Prior art flying discs made from elastomeric gels are exemplified by U.S. Pat. No. 5,324,222 to Chen, entitled Ultra-Soft, Ultra-Elastic Airfoils.

A problem associated with fabricating a flying disc from an elastomeric gel is that there exists no rigid structure to mount a light module or other electronic module. Of course, a rigid electronic module can be glued to the flexible flying disc, but this would make the body of the disc rigid, thereby eliminating the benefits of making the flying disc from an elastomeric gel.

A need therefore exists for a way to connect electronic components to a flexible elastomeric body in a manner that does not make the elastomeric body rigid. This need is met by the present invention as described and claimed below.

SUMMARY OF THE INVENTION

The present invention is an internally illuminated toy. The toy has a flexible body that is made from an elastomeric gel. The flexible body defines an internal chamber that is accessible through a small access opening. An electronics module is provided that contains a light source and a battery needed to power the light source. The electronics module is inserted into the internal chamber of the flexible body by hyper-extending the access opening to a size that enables the electronics module to pass. Once inside the internal chamber, the access opening elastically contracts and the electronics module is trapped within the flexible body. Since the electronics module is not attached to the flexible body, the electronics module does not prevent the flexible body from being stretched in any direction.

When activated, the electronics module illuminates, thereby internally illuminating the flexible body of the toy.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention can be utilized in many different types of toy projectiles, such as balls, footballs and the like, the present invention is particularly well suited for use in the fabrication of flying discs. Accordingly, the exemplary embodiment of the present invention is illustrated and described as a flying disc. This is done to set forth the best mode contemplated for the present invention. However, such an exemplary embodiment should not be considered a limitation to the application of the present invention to other thrown toy projectiles.

Figure 1:
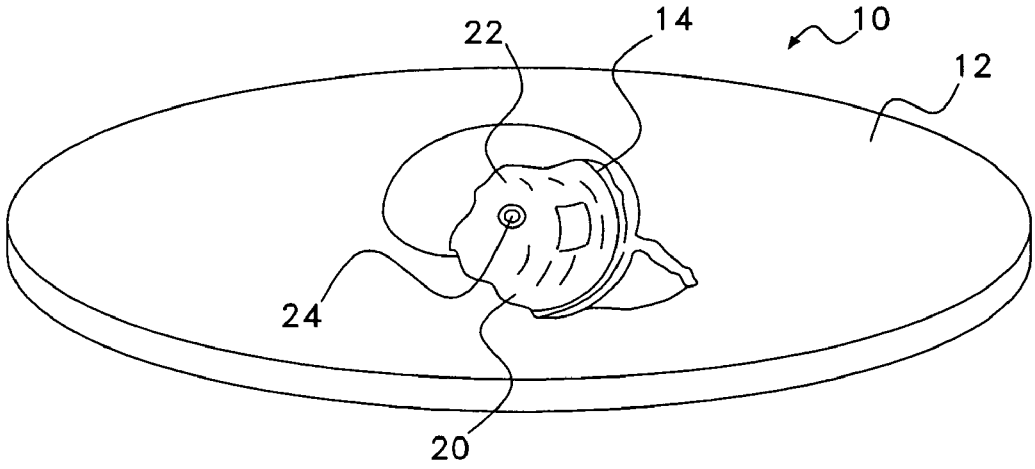
FIG. 1 is a perspective view of an exemplary embodiment of the present invention toy.

Referring to FIG. 1, a first exemplary embodiment of the present invention is shown. The shown embodiment is a flying disc 10. The flying disc 10 has a molded body 12 that is fabricated from an elastomeric gel. An appropriate elastomeric gel is described in co-pending patent application Ser. No. 10/641,795, filed Aug. 15, 2003, entitled Elastic Non-Sticky Surface Gel Material, which is incorporated into this specification by reference.

The flying disc 10 has a flexible body 12 that is shaped like a circular disc. Because the flexible body 12 is molded from an elastomeric gel, the flexible body of the flying disc is both soft and highly elastic. A cavity 14 is formed in the geometric center of the flexible body 12. As will later be explained in more detail, the central cavity 14 is created by placing a removable form in the mold when the flexible body 12 is molded from elastomeric gel.

An electronics module 20 is placed within the central cavity 14 of the flexible body 12. The electronics module 20 is a self-contained unit having a rigid housing 22 that surrounds an internal light source, power supply and control button 24. The electronics module 20 is sized to fit securely within the central cavity 14 of the flexible body 12. However, the control button 24 of the electronics module 20 can be manually manipulated through the material of the flexible body 12. Consequently, the electronics module 20 can be selectively turned on and off.

The elastomeric gel used to create the flexible body 12 is preferably translucent. Consequently, light produced by the electronics module 20 passes through the material of the elastic body 12 and the flying disk 10 glows from internal illumination.

Figure 2:
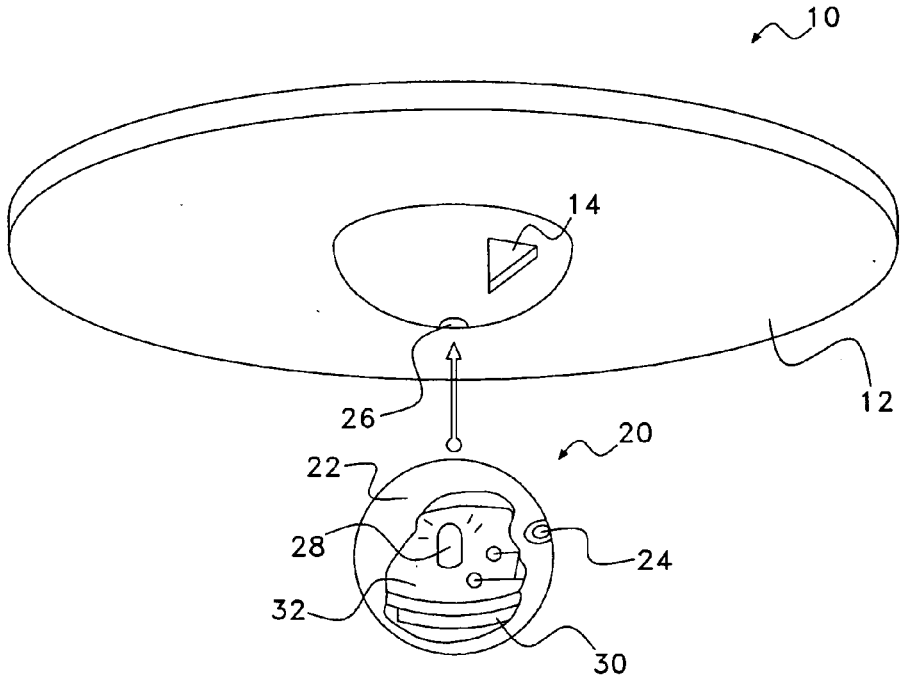
FIG. 2 is a cross-sectional view of the embodiment of FIG. 1.

Referring to FIG. 2, it can be seen that a small access hole 26 is formed in the flexible body 12 that leads to the central cavity 14. The access hole 26 is needed to remove the molding form that is used to create the central cavity 14 during molding. The access hole 26 has a diameter that is far smaller than the diameter of the electronics module 20. However, due to the physical properties of the elastomeric gel that forms the flexible body 12, the access hole 26 can be temporarily stretched open to a diameter that will enable the electronics module 20 to pass through the access hole 26 and into the central cavity 14. The moment the electronics module 20 passes through the access hole 26, it elastically contracts back to its normal size, thereby trapping the electronics module 20 within the central cavity 14.

If the electronics module 20 ever needs to be removed from the central cavity 14 for repair or battery replacement, the electronics module 20 can be pressed against the access hole 26. If pushed with enough force, the electronics module 20 will hyper-extend the access hole 26 until it opens wide enough for the electronics module 20 to pass.

The electronics module 20 has a translucent protective housing 22. Contained within the housing 22 is at least one light emitting diode (LED) 28 and a battery 30 to power the LED 28. The activation of the LED 28 is controlled by a manual control switch 24 that is present on the exterior of the protective housing 22. In addition to the LED(s) 28, the protective housing 22 also contains a small circuit board 32 with circuitry that causes the LED(s) 28 to flash in a predetermined sequence.

The electronics module 20 may also contain a noise generator and speaker so that the electronics module can produce sound in addition to light.

The housing 22 of the electronics module 20 physically protects the various electronic components from damage and contamination with water and dirt. The housing 22 retains the electronics components in place, thereby making the electronic components highly resistant to shock damage, which is important with a thrown projectile toy. The housing 22 also protects the electronic components from being damaged, should the flying disc 10 ever be stepped upon or otherwise crushed.

Figure 3:
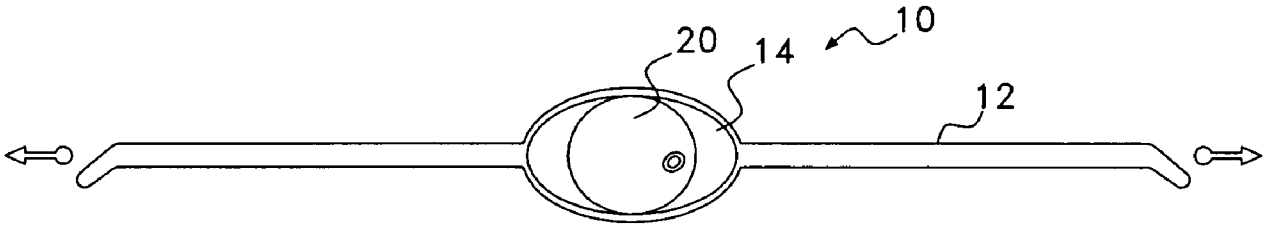
FIG. 3 is a cross-sectional view of the embodiment of FIG. 1 shown in a stretched condition.

Referring now to FIG. 3, it can be seen that since the flexible body 12 of the flying disc 10 is made from an elastomeric gel, the flexible body 12 can be stretched. When the flexible body 12 is stretched, it elongates. As the flexible body 12 elongates, so does the central cavity 14. It can be seen that the central cavity 14 retains the electronics module 20 but is not bonded to the electronics module 20. Consequently, the electronics module 20 is free to move within the central cavity 14 as the central cavity 14 elongates indifferent directions. The stretching force, therefore, never acts directly upon the electronics module 20 and the flying disc 10 can be stretched without concern of damaging the electronics module 20.

Figure 4:
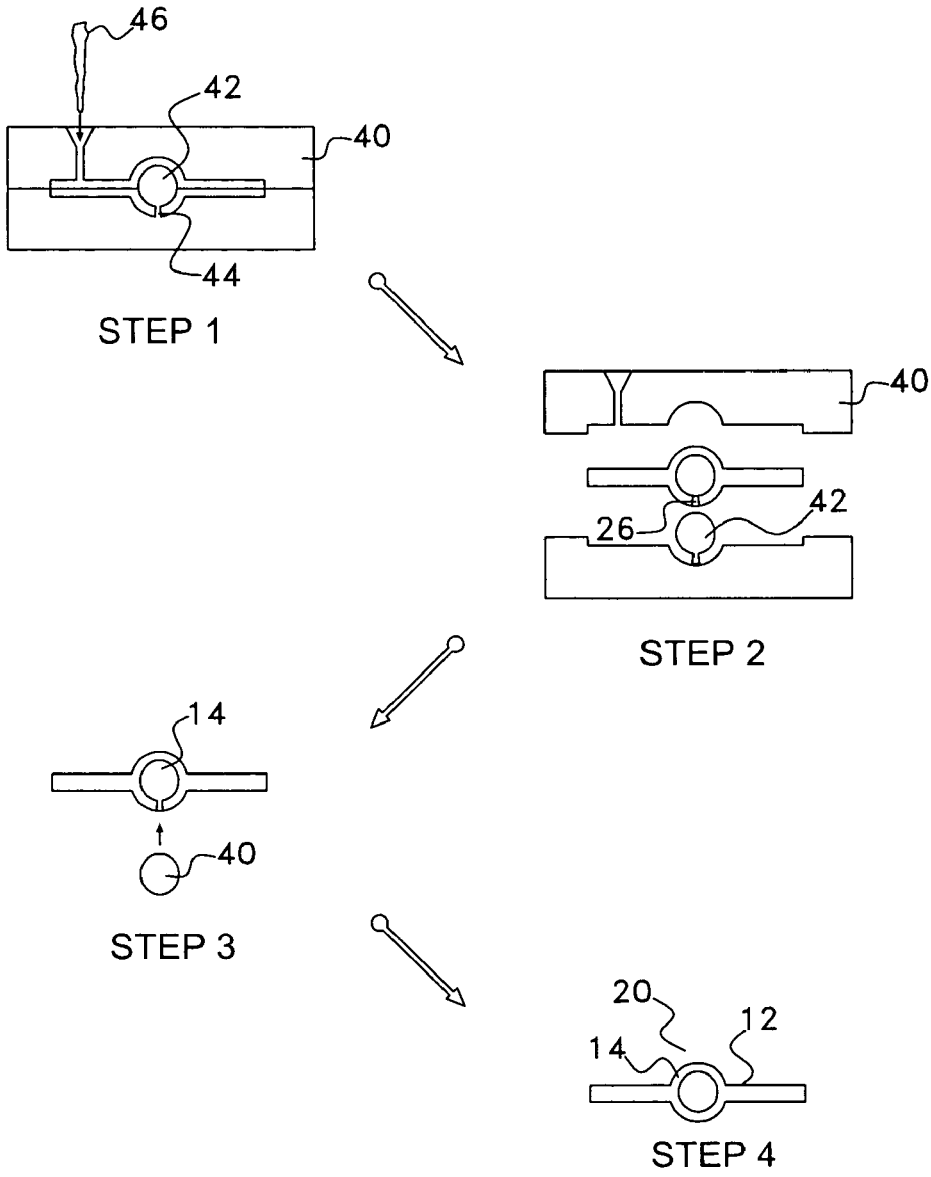
FIG. 4 is a method schematic for the manufacture of the embodiment of the present invention shown in FIG. 1.

Referring to FIG. 4, an exemplary method of manufacture is shown for the fabrication of the flying disc 10. As is indicated by Step 1, the shape of a projectile toy is formed by injection molding an elastomeric gel in a mold 40. The elastomeric gel 46 is molded around an insert 42 that forms the central cavity 14 in the molded flexible body 12. The insert 42 is supported in the mold 40 by a support shaft 44. The elastomeric gel 46 forms around the support shaft 44.

As is indicated by Step 2, the flexible body 12 is removed from the mold 40. The flexible body 12 has a central cavity 14 created by the molding insert 42. An access hole 26 is present that leads to the central cavity 14. The access hole 26 is created by the support shaft 44 that held the insert 42 in place during molding. To remove the flexible body 12 from the insert 42, the flexible body 12 is pulled off the insert 42. The access hole 26 hyper-extends and passes around the insert 42.

Referring to Step 3 in FIG. 4, it can be seen that an electronics module 20 is provided. The electronics module 20 is sized to fit within the central cavity 14 of the flexible body 12. Lastly, as is indicated by Step 4, the electronics module 20 is inserted into the central cavity 14 by again hyper-extending the access hole 26.

Figure 5:
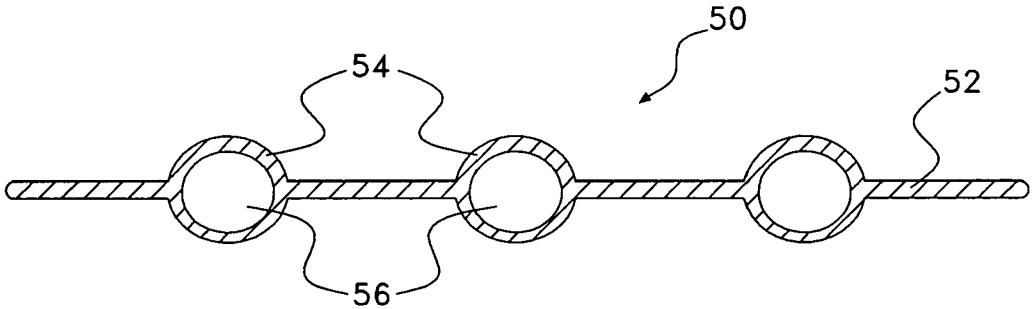
FIG. 5 is a selectively cross-sectioned view of an alternate embodiment of the present invention toy

In the embodiment of the present invention shown to this point, the flexible body 12 has only one central cavity 14 and only one electronics module 20 that fits within that central cavity 14. Referring to FIG. 5, an alternate embodiment of the present invention device is shown. In the embodiment of FIG. 5, a flying disc 50 is shown having a flexible body 52. Contained within the flexible body 52 are a plurality of cavities 54. A plurality of electronics modules 56 are provided that fit within the different cavities. The electronics modules 56 can be different sizes and have different functions. For instance, each of the electronics modules 56 can produce light of a different color. Alternatively, some of the electronics modules 56 may produce light while others produce sound. The electronics modules 56 are preferably symmetrically disposed around the center of the flying disc 50 so that the flying disc 50 is balanced while spinning during flight.

It will be understood that a person skilled in the art can make many variations to the present invention using functionally equivalent parts to the parts that are illustrated. For instance, the electronics modules need not be round, they can be oval, disc shaped or can have any other body shape. A rounded shape is preferred due to its lack of salient points that may wear against the material of the flexible body. Furthermore, the flexible body itself can be formed into many different geometric shapes. Additionally, the function of the electronics modules can be varied in many ways. The electronics modules can be made to flash in any pattern and/or play any selection of music or sounds. All such variations, modifications and alternate embodiments are intended to be included within the scope of the present invention as described and claimed below.

The invention claimed is:

1. A thrown toy projectile device, comprising:

a flexible body made from an elastomeric gel, wherein said flexible body defines an internal chamber that is accessible through an access opening of a first size;

an electronics module disposed within said internal chamber, said electronics module having a rigid housing that contains light source, wherein said electronics module is larger than said access opening;

wherein said electronic module is received and retained within said internal chamber of said flexible body by elastically deforming said access opening and passing said electronics module into said internal chamber through said access opening.

2. The device according to claim 1, wherein said flexible body is formed as a flying disc.

3. The device according to claim 1, wherein said elastomeric gel is translucent and is internally illuminated by said electronics module.

4. The device according to claim 1, wherein said electronics module contains at least one battery for powering said light source and an activation switch.

5. The device according to claim 4, wherein said housing is translucent and is internally illuminated by said light source.

6. The device according to claim 4, wherein said electronics module further includes a circuit for selectively flashing said light source in a predetermined flash pattern.

7. The device according to claim 4, wherein said electronics module further includes a sound generator for producing sound.

8. A method of forming an internally illuminated toy, comprising the steps of:

forming a flexible body from a elastomeric gel, said flexible body defining an internal chamber, wherein an access hole leads into said internal chamber through said flexible body;

providing an electronics module that is larger than said access hole in said flexible body, said electronics module containing a light and a power source for said light; and advancing said electronics module into said internal chamber by elastically hyper-extending said access hole to a size through which said electronics module can pass.

9. The method according to claim 8, wherein said step of forming a flexible body includes molding said flexible body around an insert and removing said insert from said flexible body.

10. The method according to claim 8, wherein said step of providing an electronics module includes providing a housing containing a light, a power source for said light and an activation switch for said light.

11. The method according to claim 10 wherein said step housing is translucent and is internally illuminated by said light.

12. The method according to claim 8 wherein said step of providing an electronics module includes providing a sound generator that produces sound when activated.

13. A flying disc device, comprising: a flexible disc body made from an elastomeric gel, wherein said disc body defines at least one internal chamber; and a separate electronics module enveloped within said internal chamber, wherein said electronics module has a rigid translucent housing that is not connected to said flexible disc body, and wherein said electronics module internally illuminates said flexible disc body from within said internal chamber.

14. The device according to claim 13, wherein said elastomeric gel is translucent.

15. The device according to claim 13, wherein a light with a power source that is contained within said rigid translucent housing.

* * * * *